United States Patent [19]

Hubbard et al.

[11] 4,110,032

[45] Aug. 29, 1978

[54] COPY PRODUCTION MACHINES HAVING SUPPLY SHEET PICK RETRY

[75] Inventors: James Henry Hubbard, Boulder; Wallace Lloyd Hubert, Broomfield; Paul Richard Spivey, Longmont, all of Colo.

[73] Assignee: International Business Machines Corporation, Armonk, N.Y.

[21] Appl. No.: 752,774

[22] Filed: Dec. 20, 1976

[51] Int. Cl.[2] ..... G03G 21/00

[52] U.S. Cl. ..... 355/14; 271/258

[58] Field of Search ..... 271/103, 107, 258, 259; 355/3 R, 14

[56] References Cited

U.S. PATENT DOCUMENTS

| | | | |
|---|---|---|---|
| 3,781,004 | 12/1973 | Buddendeck et al. | 355/14 X |
| 3,961,786 | 6/1976 | Yanker | 271/258 X |
| 3,970,384 | 7/1976 | Yamamoto et al. | 355/14 |
| 4,036,556 | 7/1977 | Knight et al. | 355/14 |

*Primary Examiner*—A. D. Pellinen

*Attorney, Agent, or Firm*—Herbert F. Somermeyer

[57] ABSTRACT

A copy production machine, such as a transfer electrographic copier, picks copy sheets for receiving images during a transfer operation. On rare occasions a sheet may not be successfully picked. Instead of turning the machine off and requiring manual intervention for a restart, the machine automatically retrys to repick the sheet of paper a predetermined number of times. If during such retry the pick is successful, then the copy production resumes automatically; if not, the machine is turned off after the predetermined number of cycles. During each machine cycle having an unsuccessful pick, protective actions are taken to insure that toner does not contaminate the machine and certain other actions do not provide a fire hazard. All retries are logged for maintenance assistance.

5 Claims, 10 Drawing Figures

COPY PRODUCTION MACHINES HAVING SUPPLY SHEET PICK RETRY

Documents incorporated by reference: copending commonly assigned Finlay application Ser. No. 729,451 filed Oct. 4, 1976, allowed and fee paid, shows a computer on which the programming of the best mode may be executed.

U.S. Pat. 3,955,811 shows a cut sheet apparatus as a sheet supply.

Diverse sheet supplies are shown in IBM Technical Disclosure Bulletins:

Vol. 14 No.5 October 1971, page 1535, Cut Sheet Feed Device.

Vol. 14 No. 5 October 1971, page 1455, Sheet Paper Feed System.

Vol. 14 No. 8 January 1972, page 2396, Stack Paper Feed.

Vol. 14 No. 9 February 1972, page 2789, Automatic Sequential Document Stack Feed.

Vol. 14 No. 9 February 1972, page 2786, Multiple-Hopper Paper Feed.

Vol. 14 No. 9 February 1972, page 2791, Single-Sheet Paper Supply For Reproduction Apparatus.

BACKGROUND OF THE INVENTION

The present invention relates to copy production machines of the type that use cut sheets for receiving images in a copy production process, and more particularly to those machines having error recovery techniques including sheet pick retrys.

Copy production machines in the form of convenience copiers or of printing machines often use precut sheets of paper, plastic, or other image receiving base. One or more paper supplies contained within a copy production machine will contain a predetermined number of sheets. Sheet selection or picking apparatus of diverse types have been widely employed; the selection apparatus shown in the documents incorporated by reference show exemplary sheet selection apparatus usuable with the present invention. These sheets are automatically picked synchronously with the copy machine production operation. If a sheet of paper is not successfully picked, the rest of the copy production machine has already begun a new cycle of copy production. In prior art machines such copy production machines were stopped and then required manual intervention before restarting. Such interruption of copy production reduces throughput, increases cost, and makes the machine less convenient to use. This is particularly true where the paper pick failure is of the intermittent type.

SUMMARY OF THE INVENTION

It is an object of the present invention to provide a copy production machine having paper pick retry capabilities with suppression controls for enabling automatic restarting the machine upon a successful retry pick operation.

In accordance with the invention, a copy production machine having a cut sheet supply includes means to pick a sheet from the supply. An image transfer station receives the picked sheet for transferring an image thereto and the machine has an output for removing the imaged sheet from the transfer station and stacking it in the usual manner.

The machine includes sensing means for sensing that a picked sheet is ready to enter the transfer station.

Timing means operatively associated with the transfer station indicate timed operation including the proper time for the transfer station to receive a copy sheet. Coincidence means jointly respond to the sensing means and to the timing means to indicate sheet pick failure or success. Control means respond to a failure indication to inhibit transfer of an image for one machine cycle within said image transfer station. Counter means indicate a number of successive pick failures. Further control means respond to the counter means to turn off the copy production machine after a predetermined number greater than one of pick failures. Such controls are contained in a programmable control unit.

Upon detection a pick failure certain operations are inhibited in the copy production machine. In a transfer electrographic machine, for example, the sheet of paper receives the image in the transfer station from a rotatable drum/belt. An air jet normally detaches the sheet of paper from the transfer drum/belt. During a paper pick failure such air jet is inhibited such that the air jet will not blow toner ink throughout the machine. The transfer corona is turned off. Further, while the interimage erase lamp can be turned on continuously for erasing a portion of an electrostatic image formed on the transfer element, the arrangement is such that may be disposed with. Toner advance to the toner station is also inhibited. When the machine has a semiautomatic document feed that operation is inhibited until a copy is successfully made.

The foregoing and other objects, features and advantages of the invention will be apparent from the following more particular description of preferred embodiments of the invention, as illustrated in the accompanying drawings.

THE DRAWINGS

DETAILED DESCRIPTION

Figure 1:
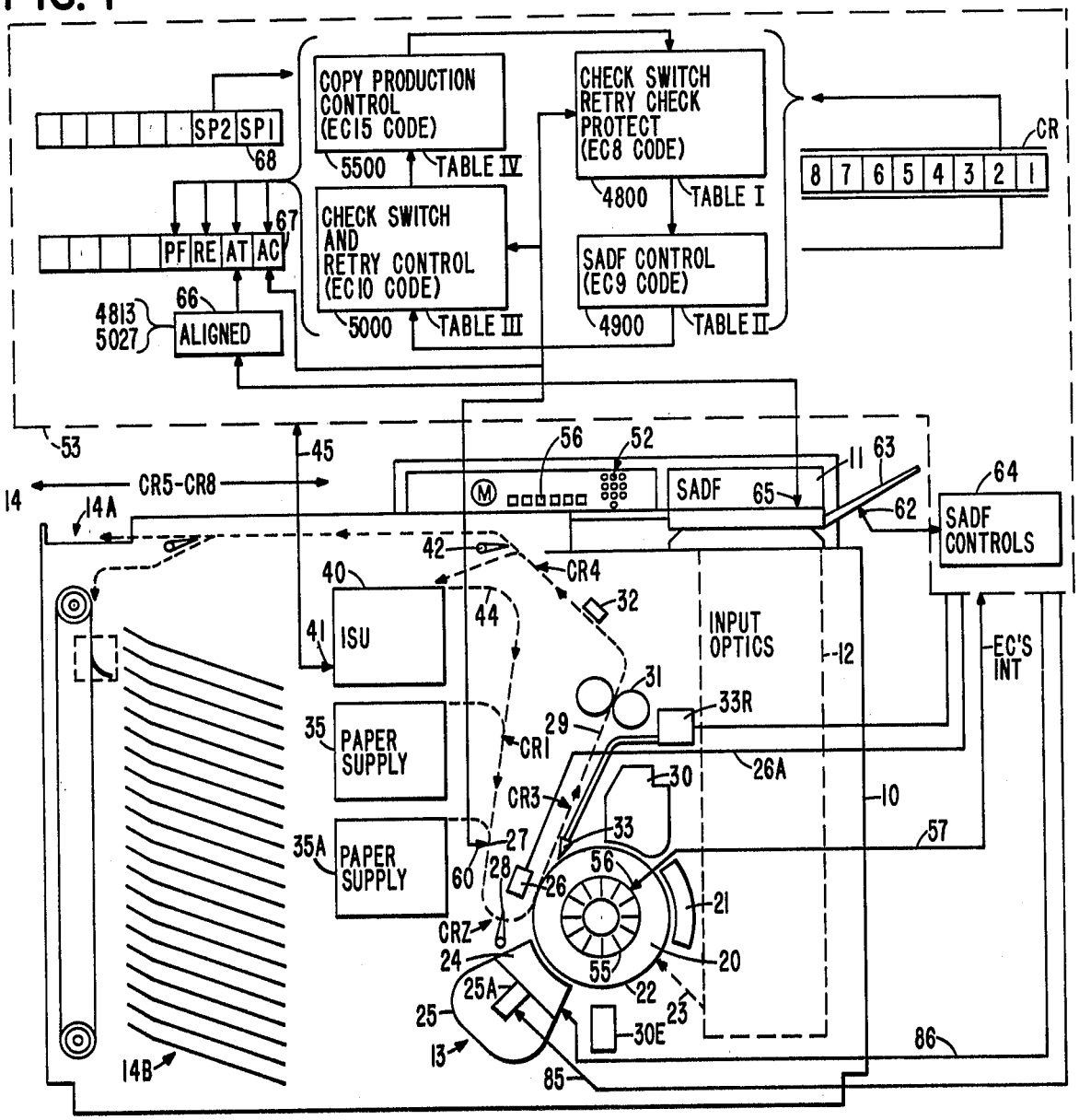
FIG. 1 is a diagrammatic showing of a copy production machine employing the present invention and including an accent of the control means used to practice the invention with respect to the illustrated transfer electrographic machine.

Referring now more particularly to the drawings, like numerals indicate like parts and structural features in the various diagrams. A copy production machine 10 employing a first version of the present invention includes a semiautomatic document feed (SADF) 11 for feeding manually inserted original documents to be copied. The document glass (not shown) in SADF 11 is scanned by know optical scanners in original input optics 12 to provide an illuminated image over path 23 to a later described copy production portion (CPP) 13. Copyproduction portion 13 transfers the line 23 indicated optical image to copy paper as will be later described, and supplies the produced copies to output portion 14 for pickup by an operator or for automatic transfer to other utilization apparatus (not shown). In a constructed version of the invention, output portion 14 includes a copy output tray 14A which receives all produced copies in a so-called noncollate mode. When the copy production machine 10 is to be used in an environment requiring automatic collation, a collator 14B is included in output portion 14.

The copy production machine 10 includes an operator's control panel 52 having the plurality of manually actuable switches for introducing copy production parameters to copy production portion 13. Such parameters are well known and are not detailed except for those parameters arbitrarily having an operative and direct relationship with a first constructed embodiment of the present invention.

Before proceeding further with the description of the invention, the operation of copy production portion (CPP) 13 is described as a constructed embodiment of a so-called xerographic copy production machine 10. Photoconductor drum member 20 rotates in the direction of the arrow past a plurality of xerographic processing stations. The first station 21 imposes either a positive or negative electrostatic charge on the surface of photoconductor member 20. It is preferred that this charge be a uniform electrostatic charge over a uniform photoconductor surface. Such charging is done in the absence of light such that projected optical images, indicated by dash line arrow 23, alter the electrostatic charge on the photoconductor member in preparation for image developing and transferring. The projected optical image from original input optics 12 exposes the photoconductor surface in area 22. Light in the projected image electrically discharges the surface areas of photoconductor member 20 in accordance with lightness. With minimal light reflected from the dark or printed areas of an original document, for example, there is no corresponding electrical discharge. As a result, an electrostatic charge remains in those areas of the photoconductive surface of member 20 corresponding to the dark or printed areas of an original document in SADF 11 (semiautomatic document feed). This charge pattern is termed a "latent" image on the photoconductor surface. Interimage erase lamp 30E discharges photoconductor member 20 outside defined image areas.

The next xerographic station is developer 24 which receives toner (ink) from toner supply 25 for being deposited and retained on the photoconductive surface still having an electrical charge. The developer station receives the toner with an electrostatic charge of polarity opposite to that of the charged areas of the photoconductive surface. Accordingly, the toner particles adhere electrostatically to the charged areas, but do not adhere to the discharged areas. Hence, the photoconductive surface, after leaving station 24, has a toned image corresponding to the dark and light areas of an original document in SADF 11.

Next, the latent image is transferred to copy paper (not shown) in transfer station 26. The paper is brought to the station 26 from an input paper path portion 27 via synchronizing input gate 28. In station 26, the copy paper (not shown) is brought into contact with the toned image on the photoconductive surface resulting in a transfer of the toner to the copy paper. After such transfer, the sheet of image-bearing copy paper is stripped from the photoconductive surface as by an air jet from detaching nozzle 33 for transport along path 29. Next, the copy paper has the electrostatically carried image fused thereon in fusing station 31 for creating a permanent image on the copy paper. During such processing, the copy paper receives electrostatic charges which can have an adverse affect on copy handling. Accordingly, the copy paper after fusing is electrically discharged at station 32 before transfer to output portion 14.

Returning now to the photoconductor member 20, after the image area on member 20 leaves transfer station 26, there is a certain amount of residual toner on the photoconductive surface. Accordingly, cleaner station 30 has a rotating cleaning brush (not shown) to remove the residual toner for cleaning the image area in preparation for receiving the next image projected by original input optics 12. The cycle then repeats by charging the just-cleaned image area by charging station 21.

The production of simplex copies or the first side of duplexing copies by portion 13 includes transferring a blank sheet of paper from blank paper supply 35, thence to transfer station 26, fuser 31, and, when in the simplex mode, directly to the output copy portion 14. Paper release gate 28 is mechanically actuated synchronously with image areas moving past developer station 24 to move a copy sheet to transfer station at the right time.

When in the duplex mode, duplex diversion gate 42 is actuated by the programmable machine controlling circuits 53 to the upward position for deflecting single-image copies to travel over path 43 to the interim storage unit 40. Here, the partially produced duplex copies (image on one side only) reside waiting for the next subsequent single image copy producing run in which the copies receive the second image. Copies residing in interim storage unit 40 constitute an intermediate copy production state.

In the next successive single image run, initiated by inserting a document into SADF 11, the copies are removed one at a time from the interim storage unit 40, transported over path 44, thence to input path 27 for receiving a second image, as previously described. The two image duplex copies are then transferred into output copy portion 14. Switch 41 of interim storage unit 40 detects whether or not there are any copies or paper in interim storage unit 40. If so, an intermediate copy production state signal is supplied over line 45 to later described machine control circuits 53.

The copy production machine 10 control panel 52 is connected to copier control circuits 53 which operate the entire machine 10 synchronously with respect to the cyclic movement of the image areas of photoconductor member 20. Billing meter M counts images processed for billing purposes.

CPP 13 also has second or alternate copy paper supply 35A which supplies copy paper to input path 27. Selection of paper supply 35 or 35A as a copy paper source is controlled from panel 52 by actuation of switch 56 labeled PRIMARY or ALTERNATE paper supply. Selection is mutually exclusive. Control circuits 53 (computer control circuits hardware is enumerated 53A) respond to switch 56 to actuate paper picker (not shown) in the respective copy paper supplies 35, 35A.

FIG. 1 also includes logic control details for accentuating the invention, showing incorporation of the paper pick retry in the illustrated copy production machine 10. Control 52 provides four primary control functions to copy production machine 10 for paper pick retry. These four functions are timed to be synchronous with the rotation of the image areas on photoconductor drum 20. To achieve this synchronization, drum 20 includes emitter wheel 55 having sensible marks indicating rotational position of drum 20. A sensor 56 generates electrical signals in response to sensing marks on emitter wheel 55 for sending "EC interrupts" over cable 57 to control 53. In one constructed embodiment there were 17 rotational indicating pulses termed EC0 through EC16, all of which indicate predetermined rotational positions in a known manner.

Figure 2:
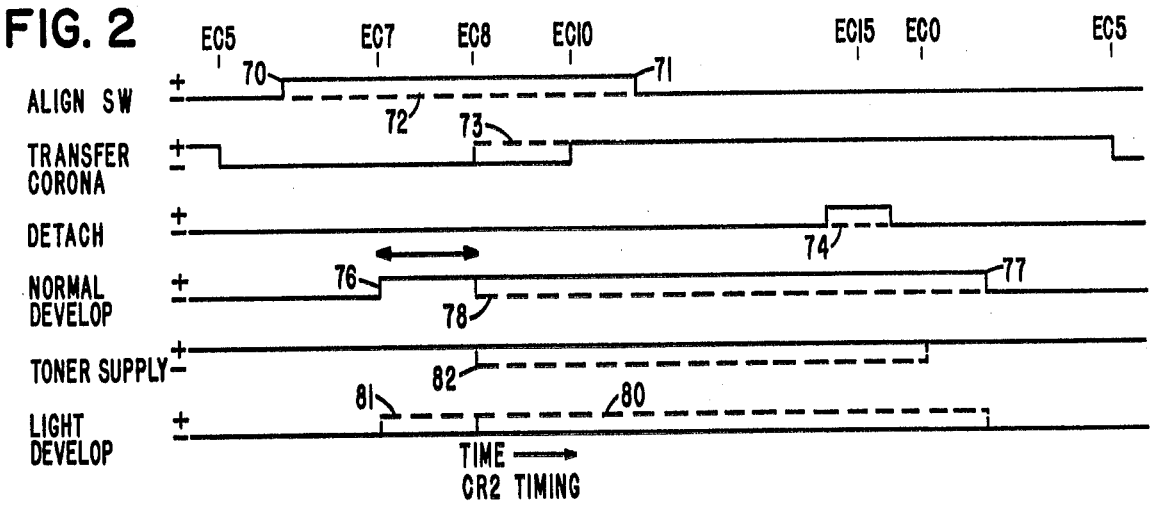
FIG. 2 is a simplified timing diagram showing an operation of the invention.
Figure 3:
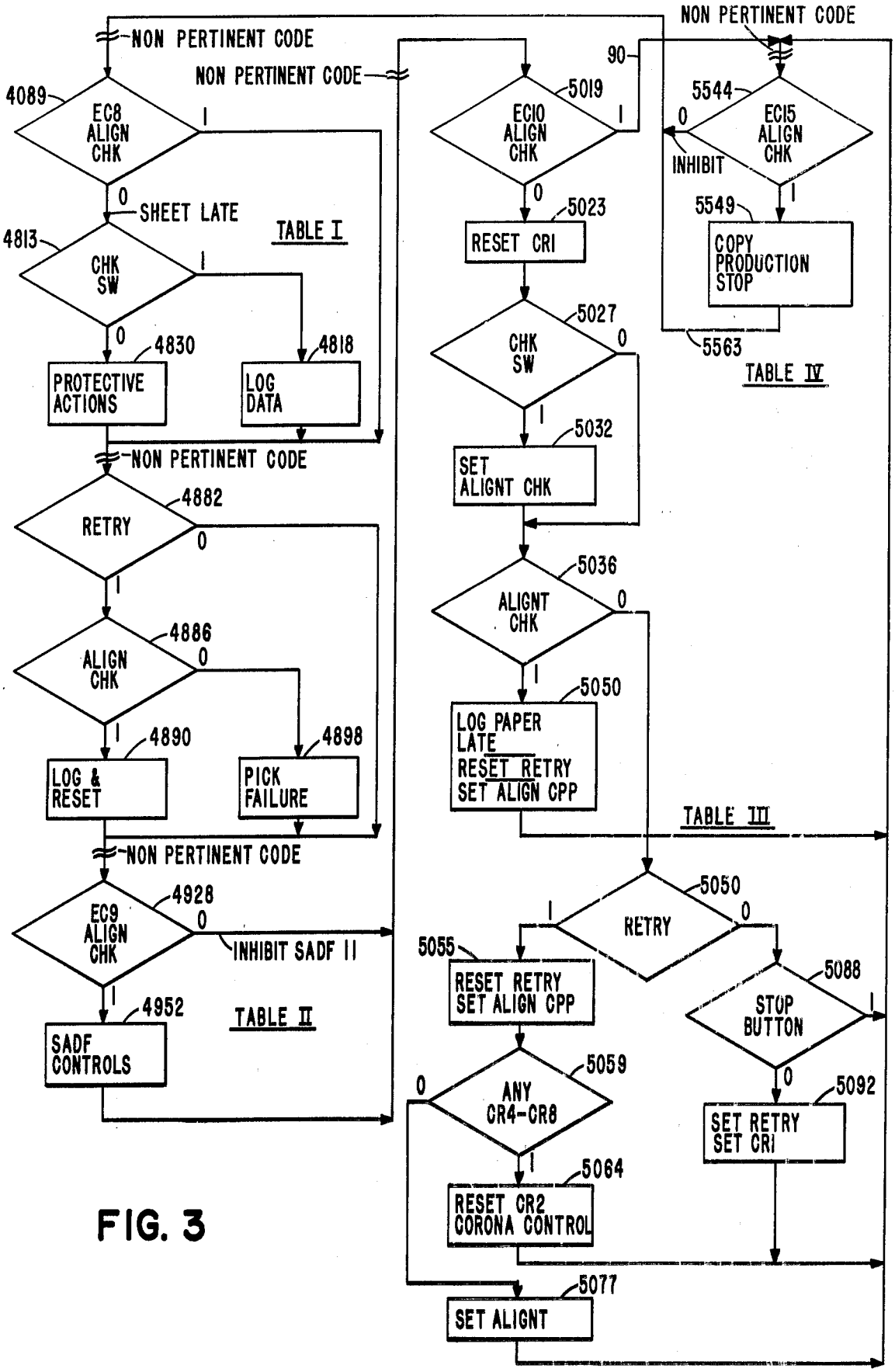
FIG. 3 is a flow chart showing the operation of the invention as practiced in the FIG. 1 illustrated machine.

Control 53 responds to the EC interrupt signals and to the paper pick failure signals as indicated by sensor 60 to alignment gate 28 to invoke a sequence of operations as detailed in FIG. 3 flow chart form and as timed in accordance with the timing signals in FIG. 2.

The four main functions are labeled 4800, 4900, 5500 and 5000, respectively corresponding to microcode listing reference numbers as will become apparent. The first function is 4800 and having a program code listing in Table I found in a later part of the description. Function 4800 is initiated by the EC8 timing pulse from emitter wheel 55 and hence is termed EC8 code. The control 53 in executing the EC8 code checks the switch 60 to determine whether or not a copy sheet has been successfully transported over path 27 to aligner gate 28. If not, the control 53 then checks whether or not a retry has been previously attempted. Further, control 53 actuates CPP 13 to protect against contamination by the toner from supply 25 as will be more fully later described. Then at timing pulse EC9 code 4900, the control 53 inhibits SADF control such that additional documents are not fed during the dummy cycle as will be later more fully described. Then at EC10 time (5000 code), the control 53 checks switch 60 and exercises certain retry control over CPP 13. Finally, at EC15 time (5500 code), certain copy production control is inhibited.

Control 53 exercises timed synchronization of copy production machine 10 by copy transport states memorized in a computer memory. A single register of the memory termed CR (cycle record) memorizes the eight possible cycle states for a given sheet of paper to be transported through the copy production machine 10. CR1 when set indicates a sheet of paper is to be picked. Similarly CR2 indicates that the picked sheet of paper should have arrived at aligner gate 2B and that copy production steps of develop, transfer, etc. should be performed. CR3 indicates a sheet of paper should have left the transfer station 26. CR4 indicates that the sheet of paper should have left fuser station 31. CR5 through CR8 are transport states associated with output portion 14 and not pertinent to the present invention.

SADF 11 includes a sensor 62 indicating that an original document is in the SADF tray 63. This sensor actuates the SADF controls 64 (program steps in control 53) for transporting the original document onto the document glass as is well known in the art. Further, a sensor 65 can indicate that a document is on the document glass within SADF 11. If so, a signal is supplied to an aligned latch 66 within control 53. In a practical embodiment the align latch 66 is a portion of a microcode structure at 4813 and 5027 will become apparent. Latch 66 sets an AT bit corresponding to a memory register 67 as will become more apparent. Memory register 67 has a plurality of control bits having an effect on the execution of the code at 4800, 4900, 5000 and 5500. Similarly, a second memory register 68 has a pair of bits SP1 and SP2 also exercising a control function on copy production machine 10 via the programmed control.

FIG. 2 illustrates the reproduction machine 10 timing for controlling the machine with respect to a sheet of paper that supposedly is at aligner gate 28 as represented at the programmable control 53 by the digit CR2. Timing pulse EC0 is a reference pulse. Pulses EC7 and EC8 indicate time as will be later described, at which it is expected a sheet of paper from one of the supplies 40, 35, 35A to have reached and be aligned at aligner gate 28. In prior ECs, i.e., EC0 thru EC7, the document on the document glass (not shown) of SADR 11 has been projected over path 23 and has been imposed upon drum 20. At EC8 a first portion of the exposed drum image surface 22 is beginning to receive toner from station 24.

The aligner switch signal is solid line indicates the window at which time the aligner switch should be actuated. That is, at 70 is the earliest expected time for a sheet of paper to arrive at 60, while at 71 is the latest time that the trailing edge of the paper will leave 60. In the event of a paper pick failure, switch 60 is never closed;, therefore, the aligner switch from switch 60 remains inactive as indicated by dashed line 72.

The transfer corona (not shown) of transfer station 26 is normally on from EC10 through EC5. Therefore, at time EC10 the exposed image at area 22 has completely passed erase station 30E and is receiving toner from station 24. In the case of a paper pick failure it is desired to limit the amount of toner on drum 20 during the cycle of machine 10 corresponding to the paper pick failure. Accordingly, when the machine detects no sheet of paper at aligner switch 60 at time EC8 a paper pick failure is identified, the transfer corona in station 26 is turned off via line 26A.

Air jet 33 detaches the sheet of paper from photoconductor drum 20 and allows it to enter fuser station 31. Detach under normal operating conditions is actuated at EC15 and deactuated at EC0 as indicated by the solid line detach signal. In the case of a paper pick failure the machine cycle immediately following the failure inhibits the detach action as indicated by dashed line 74. The detach is inhibited such that the air from jet 33 will not blow toner, which is resident on the photoconductor drum 20, from transfer station 26 to other portions of the machine. It will be remembered that a portion of the image imposed upon photoconductor drum 20 via path 23 has already been toned with ink in station 24. Since no paper passes through aligner gate 28 to transfer station 26 the toner still resides on photoconductor drum 20. Of course, cleaner station 30 will remove the toner from the drum as it continues its rotation.

The development cycle of station 24 merely places toner ink on a photoconductor surface such that the toner ink adheres to the electrically charged portions of the photoconductor drum 20 surface for creating a latent image. The normal develop signal which creates a bias signal in the developing station for a magnetic developing brush is normally turned on during EC7 such as at 76 and turned off just following EC0 such as at 77. In the event of a paper pick failure the cycle following the failure during which no paper is being transported through the transfer station 26, the magnetic bias of the normal intensity is removed at EC8 and remains removed for the rest of the cycle as indicated by dash line 78. However, in order to maintain a minimum amount of toner transfer from the developing station 24 to the photoconductor drum 20 a predetermined bias should be applied to the magnetic developing brush. Through experimentation the most advantageous bias for the constructed embodiment of the present invention was a so-called light development bias which is normally used for developing copies from images having very intense lines. Light development bias is supplied to the magnetic brush at EC8 and remains on until normal turn off time as indicated by dash line 80. In other constructed embodiments of the invention it may be more advantageous to supply other than the light developed bias voltage to the magnetic development brush. In the event the light development has been selected by the operator, then it would follow its normal course of turn on and turn off as indicated by dash line 81.

The last protective action insofar as the photoconductor drum 20 is concerned involves inactivating the toner supply 25 from supplying toner to developing station 24. During normal copying processes toner supply is continuously operative to supply toner to the magnetic development brush (not shown) within developer station 24. However, upon detection of a paper pick failure and a retry is being initiated, the toner supply is inhibited in the cycle immediately following the paper pick failure beginning at EC8 and extending to EC0 as indicated by dash line 82. In a constructed embodiment of the invention, toner supply 25 included a conveyor, such as an auger 25A, which was merely deactivated during the cycle following the paper pick failure.

Machine control 53 includes a programmed computer set up as described in the Finlay application supra. However, to more particularly point up the invention the program execution will be described with respect to flow chart of FIG. 3 with the incorporation of source code at the instruction level usuable with the programmable computer described in the Finlay application, supra. The numerals in FIG. 3 correspond to the source code relative address. For example, numeral 4089 representing a branch instruction entitled "EC8 ALIGN CHK" corresponds to relative address 4809 in Table I below. This correlation between the flow chart and the source code makes the source code easier to read. It should be understood that in a programmable controlled copy production machine 10 that the instructions represented by the flow chart of FIG. 3 are those instructions particularly pointed to practicing the invention in that machine. Interleaved between the instructions as shown in FIG. 3 will be many other instructions for performing other functions necessary for a successful operation of a copy production machine 10 but not necessary for an understanding or the implementation of the present invention in such a copy production machine. For simplifying identifying the interleaved instructions, all of the instructions in FIG. 3 have been set up in four tables corresponding to the four blocks 4800, 4900, 5000, 5500 of FIG. 1 each of the ECs, EC0 through EC16 (not all shown in this application).

The EC8 code beginning at relative address 4800 is entered at branch instruction 4809, at which time switch 60 (FIG. 1) is sensed to see whether or not it is closed. If it is closed a binary one signal is supplied to programmable control 53 indicating that a sheet of picked paper has arrived at aligner gate 28. In the program of instructions (not shown) aligner switch 60 was sensed at EC7. If a sheet of paper was detected at EC7 then programmable control 53 sets latch AC of memory register 67 to the active position. For the EC8 code at 4809 program control executes a branch instruction which checks latch AC at time EC8 for determining whether or not the sheet of paper had been sensed at EC7. If so, a binary one state is set in latch AC causing the program to move it directly to the next branch instruction 4882, as later described. If the paper was not received at aligner switch 60 at time EC7 the sheet is late as indicated by the binary zero state of latch AC. Then the control via branch instruction 4813 checks the actual condition of switch 60. If closed, a binary one signal is detected from switch 60 causing the program control to execute instructions at 4818 for logging the data that the sheet was late at aligner switch 60. The data is logged in a later described nonvolatile CMOS memory.

On the other hand, if the sheet of paper is not at switch 60 at time EC8, the binary zero signal from switch 60 causes the program control to execute instructions at 4830 initiating protective actions for copy production machine 10 to prevent contamination and other problems from occurring during the machine cycle following the paper pick failure during which cycle no sheet of paper will go through transfer station 26. The protective actions, including deactivating the toner conveyor by supplying an active signal over line 85 (FIG. 1), turning off transfer corona in transfer station 26 and setting the magnetic brush bias to light development copy by a signal supplied over cable 86 to station 24. In this regard, the cable 86 includes a plurality of lines for setting a bias respectively to normal, dark or light as is well known in the copy production arts.

Following the protective actions, the program control then enters the last portion of the EC8 code that pertains to the present invention. At branch instruction 4882 latch RE of memory register 67 is checked for its signal state. If it is a zero this means that no previous retry for paper pick has occurred. If, on the other hand, RE is set to the one state a previous retry has occurred. Upon the zero state the program control immediately exits the EC8 CR2 code and enters code (not shown) not pertinent to the present invention and not shown herein. If, on the other hand, a retry for paper pick has occurred, then at 4886 the program control checks to see whether or not latch AC is set to the active condition. If set to the one state a sheet of paper has covered switch 60 at aligner gate 28; i.e., the retry was successful. Then the program control executes an instruction 4890 which logs the paper pick failure and successful retry, rests the aligner check latch AC and proceeds to nonpertient code. On the other hand, if latch AC is to the zero state the program control goes from branch instruction 4886 to log a pick failure at 4898 and turn off the machine.

In Table I immediately below, such protective actions are shown in source code executable on the computer shown in the Finlay application, supra.

TABLE I

| LOC | OBJ | OP1 | OP2 | SOURCE STATEMENT | | | REF |
|---|---|---|---|---|---|---|---|
| | | | | BEGIN | EC8 CODE | | 4788 |
| | | 7A9E | EC8 | DC | * | | |
| | | | | 1. IF (CR2\|CR3) & B4 | | 4790 | |
| 7A9E | E4 | 0004 | | LR | CRREG | LOAD CR REGISTERS' REGISTER | |
| 7A9F | AB60 | 0060 | | NI | P1(CR2,CR3) | TEST IF C2 \|CR3 IS ACTIVE | |
| 7AA1 | 3569 | 7B69 | | BZ | EC8S | CR2&CR3 NOT ACTIVE-BRANCH TO END OF EC8 CODE | |
| 7AA3 | A6A1 | 01A1 | | LBL | COUNTRY | LOAD COUNTRY INDICATION BYTE | |
| 7AA5 | 90 | 0000 | | TP | B4 | TEST IF B4 MACHINE | |
| 7AA6 | 40 | 7AB0 | | JZ | EC8A1 | IF NOT BRANCH AROUND | |
| | | | | 1. THEN | | | 4797 |
| | | | | 2. . RESET BSSTBY,RTRYBIAS | | | 4798 |

TABLE I-continued

```
LOC   OBJ     OP1   OP2      SOURCE STATEMENT                                REF
                             TRMB  PSB47,P(BSSTBY,RTRYBIAS)
7AA7  A66F    006F
7AA9  AB3F    003F
7AAB  A16F    006F
                          2. . CALL BRSHBCON                                 4800
7AAD  33C52   0003   52C0    BAL   R3,BRSHBCON
                          1. ENDIF                                           4802
      7AB0       EC8A1       DC    *
                          1. IF CR2 & NOT CENOPAPR                           4804
7AB0  E4      0004           LR    CRREG
7AB1  96      0006           TP    CR2
7AB2  354C    7B4C           BZ    EC8A
7AB4  A662    0062           LS    CEMODE
7AB6  A803    0003           CI    CENOPAPR
7AB8  354C    7B4C           BE    EC8A
                          1. THEN                                            4808
                          2. . IF ALIGNER FAILURE AT EC7(ALIGNOK=0)          4809
                             TPB   PSB23,ALIGNOK
7ABA  A657    0057
7ABC  95      0005
7ABD  3CEA    7AEA           BNZ   EC8B1
                          2. . THEN                                          4812
                          3. . . IF ALIGNER SW=1                             4813
                             RIN   CSB02
7ABF  A6C1    00C1
7AC1  90      0000           TP    CPYATAL
7AC2  43      7AD3           JZ    EC8B0
                          3. . . THEN                                        4817
                          4. . . . SET ALIGNOK & ALGNSLOW                    4818
                             TSMB  PSB23,P(ALIGNOK, ALGNSLOW)
7AC3  A657    0057
7AC5  AF21    0021
7AC7  AF57    0057
                          4. . . . CALL LOGBIN - LOG PAPER SLOW(101)         4820
                             LID   X'0101'
7AC9  AE01    0101
7ACB  29
7ACC  AE01    0101
7ACE  32C04D  0002   4DC0    BAL   R2,LOGBIN
7AD1  2CEA    7AEA           B     EC8B1
      7AD3       EC8B0DC  *
                          3. . . ELSE                                        4825
                          4. . . . DEACTIVATE CONVEYOR                       4830
7AD3  A67B    007B           LB    PCB11
7AD5  B6      0006           TR    CONVYER
                             STOUT 11
7AD6  A17B    007B           STB   PCB11
7AD8  A1D2    00D2           STB   CCB11
                          4. . . . DEACTIVATE TRANSFER CORONA (XFERCOR)
7ADA  A67F    007F           LB    PCB15
7ADC  B6      0006           TR    XFERCOR
                             STOUT 15
7ADD  A17F    007F           STB   PCB15
7ADF  A1D6    00D6           STB   CCB15
                          4. . . . SET RETRY BIAS BIT - RTRYBIAS
                          4. . . . CALL BRSHBCON -TO SET BIAS TO LIGHT COPY  4834
                             TSB   PSB47,RTRYBIAS
7AE1  A66F    006F
7AE3  AF40    0006
7AE5  A16F    006F
7AE7  33C052  0003   52C0    BAL   R3,BRSCHBCON                              4837
                          3. . ENDIF
      7AEA       EC8B1       DC    *
                          2. . ENDIF                                         4839
                          2. . IF ALIGNOK=1                                  4840
                             TPB   PSB23,ALIGNOK
7AEA  A657    0057
7AEC  95      0005
7AED  352D    7B2D           BZ    EC8B4
                          2. . THEN                                          4843
                          3. . . IF DUPLEX INDICATOR & NOT SIDE2             4844
                             TBP   PCB05,DPLXIND
7AEF  A676    0076
7AF1  92      0002
7AF2  3501    7B01           BZ    EC8B2
                             TPB   PSB20,DPXSIDE2
7AF4  A654    0054
7AF6  95      0005
7AF7  61      7B01           JNZ   EC8B2
                          3. . . THEN                                        4849
                          4. . . . DUPLEX VANE DWN                           4850
7AF8  A673    0073           LB    PCB02
7AFA  AF40    0006           TS    DPLXVANE
                             STOUT 02
7AFC  A173    0073           STB   PCB02
7AFE  A1C1    00C1           STB   CCB02
7B00  08      7B08           J     EC8B3
                          3. . . ELSE                                        4855
      7B01       EC8B2       DC    *
                          4. . . . DUPLEX VANE UP                            4857
7B01  A673    0073           LS    PCB02
7B03  B6      0006           TR    DPLXVANE
                             STOUT 02
```

TABLE I-continued

```
LOC   OBJ    OP1   OP2      SOURCE STATEMENT                                    REF
7B04  A173   0073           STB    PCB02
7B06  A1C1   00C1           STB    CCB02
                         3. . . ENDIF                                          4861
             7B08  EC8BDC  *
                         3. . . IF NOT LGHTCPY1 & NOT NOEARLYF &CEMODE NOT =3  4863
                              & NOT CENOPAPR & NOT CR4 & NOT PRECOND
                              TPB    PCB05,LGHTCPY1
7B08  A676   0076
7B0A  93     0003
7B0B  3C2D   7B2D           BNZ    EC8B4
                            TPB    PSB47,NOEARLYF
7B0D  A66F   006F
7B0F  94     0004
7B10  3C2D   7B2D           BNZ    EC8B4
7B12  A662   0062           LS     CEMODE
7B14  A803   0003           CI     3
7B16  3D2D   7B2D           BE     EC8B4
7B18  A803   0003           CI     CENOPAPR
7B1A  3D2D   7B2D           BE     EC8B4
                            TPB    CRLO,CR4
7B1C  A604   0004
7B1E  94     0004
7B1F  3C2D   7B2D           BNZ    ED8B4
                            TPB    PSB07,PRECOND
7B21  A647   0047
7B23  90     0000
7B24  6D     7B2D           JNZ    EC8B4
                         3. . . THEN                                           4873
             7B25  EC8B3A   DC     *
                         4. . . . CLOSE FUSER ROLL                             4875
7B25  A67A   007A           LS     PCB10
7B27  AF80   0007           TS     FUSEROL
                            STOUT  10
7B29  A17A   007A           STB    PCB10
7B2B  A1D1   00D1           STB    CCB10
                         3. . . ENDIF                                          4879
             7B2D  3C8B4    DC     *
                         2. . ENDIF                                            4881
                         2. . IF RETRY=1                                       4882
                            TPB    PSB07,RETRY
7B2D  A647   0047
7B2F  92     0002
7B30  3D4C   7B4C           BZ     EC8A
                         2. . THEN                                             4885
                         3. . . IF ALIGNOK=1                                   4886
                            TPB    PSB23,ALIGNOK
7B32  A657   0057
7B34  95     0005
7B35  44     7B44           JZ     EC8B5
                         3. . . THEN                                           4889
                         4. . . . LOG SUCCESSFUL RETRY & RESET RETRY INDICATOR 4890
                         4. . . . CALL LOGBIN - LOG CODE(103)                  4891
                            LID    X'0103'
7B36  AE01   0103
7B38  29
7B39  AE03   0103
7B3B  32C04D 0002  4DC0     BAL    R2,LOGBIN
                            TRB    PSB07,RETRY
7B3E  A647   0047
7B40  B2     0002
7B41  A147   0047
7B43  0C     7B4C           J      EC8A
                         3. . . ELSE                                           4896
             7B44  EC8B5    DC     *
                         4. . . . LOG UNSUCCESSFUL RETRY                       4898
                         4. . . . CALL LOGBIN - LOG CODE (104)                 4899
                            LID    X'0104'
7B44  AE01   0104
7B46  29
7B48  AE04   0104
7B49  32C04D 0002  4DC0     BAL    R2,LOGBIN
                         3. . . ENDIF                                          4902
                         2. . ENDIF                                            4903
                         1. ENDIF                                              4904
             7B4C  EC8A     DC     *
                         1. IF CR3 & NOT PRECOND & NOT CENOPAPR                4906
```

In the above table the first few instructions beginning at 4790 have to do with the copy production machine capable of making copies in a so-called B4 size paper as opposed to an 8.5 × 11 inch size paper. Instructions pertinent to the present invention begin at 4809 and continue through 4904. Beginning at 4906 the EC8 code pertains to the paper transport status CR3; i.e., a sheet of paper having left transfer station 26 and not yet arriving at fuser station 31 is executed. Since that portion of the copy production machine is not pertinent to an understanding of the present invention, it is dispensed with. In all other portions of the code at 4900, 5000 and 5500 the code pertains to those instructions executed for CR2 at the respective EC times.

The EC9 code relates to the control of SADF 11, i.e., should an original document be transported from SADF tray 63 as indicated by aligner switch 62 being activated onto the document glass (not shown) within the SADF 11. Such SADF controls 64 are represented by the code listing in Table II below; it is to be understood that additional SADF controls (not shown) are exercised by program control 53.

TABLE II

```
LOC    OJB   OP1   OP2                SOURCE STATEMENT                                  REF
                                      BEGIN   EC9 CODE                                  4921
             7B6C        EC9          DC      *
                                 1. IF CR2
7B6C   E4    0004                     LR      CRREG          LOAD CR REGISTERS' REGISTER
7B6D   96    0006                     TP      CR2            TEST IF CR2 IS ACTIVE
7B6E   3D87  7B87                     BZ      EC9A           CR2 NOT ACTIVE-BRANCH TO CR3 TEST
                                 1. THEN
                                 2. . IF ALIGNER NOT ACTIVE EC7&EC8 (ALIGNOK=0)            4928
7B70   A657  0057                     LB      PSB23          LOAD PROGRAM STATUS BYTE
7B72   95    0005                     TP      ALIGNOK        TEST IF ALIGNOK IS ACTIVE
7B73   3C80  7B80                     BNZ     EC9C           IF NOT ACTIVE-
                                 2. . THEN
                                 3. . . CHECK ALIGNER SW (IF ACTIVE-ALIGNTOK=1)
7B75   29                             TRA                    TRANSPOSE ACCUM
                                      RIN     CSB02          LOAD CONTROL STATUS BYTE
7B76   A6C1  00C1
7B78   90    0000                     TP      CPYATAL        CHECK ALIGNER SWITCH
7B79   3D80  7B80                     BZ      EC9C
7B7B   29                             TRA                    TRANSPOSE ACCUM
7B7C   AF80  0007                     TS      ALIGNTOK
7B7E   A157  0057                     STB     PSB23
             7B80        EC9C         DC      *
                                 2. . ENDIF
                                              NONPERTINENT EC9 CODE.
                                              BELOW SADF CODE EXECUTES 4952.
                                 1. IF LIDDWNSW=1
                                      RIN     CSB09
5B90   A6D0  00D0
5B92   95    0005                     TP      LIDDWN
5B93   3DBB  5BBB                     BZ      SADF06
                                 1. THEN
                                 2. . IF NOT FLUSH
                                      TPB     PSB07,FLUSH
5B95   A647  0047
5B97   91    0001
5B98   3CB0  5BB0                     BNZ     SADF05
                                 2. . THEN
                                 3. . . IF CR1 &POPLIDMEM
5B9A   A604  0004                     LB      CRL0
5B9C   97    0007                     TP      CR1
5B9D   3DB9  5BB9                     BZ      SADF05A
                                      TPB     PSB31,POPLIDM
5B9F   A65F  005F
5BA1   97    0007
5BA2   3DB9  5BB9                     BZ      SADF05A
                                              NONPERTINENT CODE
                                              RELATING TO OTHER ASPECTS OF SADF 11
                                 1. IF STARTL |CR1 |(CR2&((B4 &EC<11) |EC<9 |ALIGNOK=0))
                                      TPB     PSB22,STARTL
5BF0   A656  0056
5BF2   96    0006
5BF3   3413  5C13                     BNZ     SADF11
5BF5   A604  0004                     LB      CRL0
5BF7   97    0007                     TP      CR1
5BF8   3413  5C13                     BNZ     SADF11
5BFA   96    0006                     TP      CR2
5BFB   351D  5C1D                     BZ      SADF12
5BFD   A6A1  01A1                     LBL     COUNTRY
5BFF   90    0000                     TP      B4
5C00   49    5C09                     JZ      SADF10
5C01   AE0B  000B                     LI      11
5C03   A261  0061                     SB      ECCOUNT
5C05   3E13  5C13                     BH      SADF11
5C07   2C0F  5C0F                     B       SADF10A
             5C09        SADF10       DC      *
5C09   AE09  0009                     LI      9
5C0B   A261  0061                     SB      ECCOUNT
5C0D   3E13  5C13                     BH      SADF11
             5C0F        SADF10A      DC      *
                                      TPB     PSB23,ALIGNOK
5C0F   A657  0057
5C11   95    0005
5C12   6D    5C1D                     JNZ     SADF12
                                              NONPERTINENT CODE RELATING TO
                                              OTHER ASPECTS OF CONTROLLING SADF 11
5D7B   B2    0002
5D7C   A179  0079
5D7E   2C9D  5D9D                     B       SADF26
                                 5. . . . . ELSE
             5D80        SADF25       DC      *
                                 6. . . . . . DECREMENT ALIGNTMR
5D80   A64B  004B                     LB      ALIGNTMR
5D82   2A                             S1
5D83   A14B  004B                     STB     ALIGNTMR
                                 6. . . . . . IF ALIGNTMR=0
5D85   A800  0000                     CI      0
5D87   3E9D  5D9D                     BH      SADF26
                                 6. . . . . . THEN
                                 7. . . . . . . DFENTRY=1
                                 7. . . . . . . DFBELT=1
```

TABLE II-continued

| LOC | OJB | OP1 | OP2 | SOURCE STATEMENT | | REF |
|---|---|---|---|---|---|---|
| | | | | TSMB | PCB09,P(DFBELT,DFENTRY) | |
| 5D89 | A679 | 0079 | | | | |
| 5D8B | AF60 | 0060 | | | | |
| 5D8D | A179 | 0079 | | | | |
| | | | | 7. . . . . | ENTERING=1 | |
| | | | | 7. . . . . | SADFBUSY=1 | |
| | | | | 7. . . . . | POPLIDMEM=0 | |
| 5D8F | A65F | 005F | | LB | PSB31 | |
| 5D91 | AF08 | 0003 | | TS | SADFBUSY | |
| | | | | TRM | P(POPLIDM,ENTERING) | |
| 5D93 | AB7E | 007E | | | | |
| 5D95 | A15F | 005F | | STB | PSB31 | |
| | | | | 7. . . . . | SADFTMR=386 | |
| | | | | LID | 386 | |
| 5D97 | AE01 | 0182 | | | | |
| 5D99 | 29 | | | | | |
| 5D9A | AE82 | 0182 | | | | |
| 5D9C | 8A | 000A | | STR | SADFTMR | |
| | | | | 6. . . . . | ENDIF | |
| | | | | 5. . . . . | ENDIF | |

In the table above and in the flow chart portion of FIG. 3, program control 53 by instruction 4928 checks latch AC of memory register 67. If it is a zero this means no sheet of paper is at aligner gate 28 and SADF 11 operations are to be inhibited. Inhibition of SADF 11 is achieved by bypassing the programming at 4952 which exercises control over SADF 11. From branch instruction 4928 in the event of aligner check, the program control 53 proceeds immediately to the CR3 code of EC9, i.e., nonpertinent code. From thence, the program control 53 awaits EC10 interrupt pulse at which time the EC10 code is executed.

In the event there was a successful paper pick (normal case) the SADF controls beginning at 4952 actuate SADF 11 as by actuating its belt (not shown) for transporting an original document from tray 63 onto the document glass (not shown). It should be noted that in the code not illustrated in FIG. 3 that at 4933 the aligner switch 60 is checked following checking latch AC of memory register 67.

Th EC10 code 5000 relates to retry controls exercised over copy production machine 10 by control 53 as shown in Table III below.

TABLE III

| LOC | OBJ | OP1 | OP2 | SOURCE STATEMENT | | | REF |
|---|---|---|---|---|---|---|---|
| | | | | BEGIN | EC10 CODE | | 5002 |
| | | 7BAD | EC10 | DC | * | | |
| | | | | 1. IF CR2 | | | |
| 7BAD | E4 | 0004 | | LR | CRREG | LOAD CR REGISTERS' REGISTER | |
| 7BAE | 96 | 0006 | | TP | CR2 | TEST IF CR2 IS ACTIVE | |
| 7BAF | ECB4 | 7BB4 | | BNZ | EC10AB | | |
| 7BB1 | 30EC7C | 7CEC | 0000 | BU | EC10F,R0 | | |
| | | 7BB4 | EC10AB | DC | * | | |
| | | | | 1. THEN | | | |
| | | | | 2. . IF NOT B4 | | | |
| 7BB4 | A6A1 | 01A1 | | LBL | COUNTRY | | |
| 7BB6 | 90 | 0000 | | TP | B4 | | |
| 7BB7 | 6D | 7BBD | | JNZ | EC10A | | |
| | | | | 2. . THEN | | | |
| | | | | 3. . . ALLOW | FUSER TURN-ON | (SCANTM=0) | 5015 |
| | | | | TRB | PSB20,SCANTM | | |
| 7BB8 | A654 | 0054 | | | | | |
| 7BBA | B6 | 0006 | | | | | |
| 7BBB | A154 | 0054 | | | | | |
| | | | | 2. . ENDIF | | | |
| | | 7BBD | EC10A | DC | * | | |
| | | | | 2. . IF NOT PRECOND | | | |
| | | | | TPB | PSB07,PRECOND | | |
| 7BBD | A647 | 0047 | | | | | |
| 7BBF | 90 | 0000 | | | | | |
| 7BC0 | 44 | 7BC4 | | JZ | EC10BA | | |
| 7BC1 | 30EC7C | 7CEC | 0000 | BU | EC10F,R0 | | |
| | | | | 2. . THEN | | | |
| | | 7BC4 | EC10BA | DC | * | | |
| | | | | 3. . . IF ALIGNOK=0 | | | 5019 |
| 7BC4 | A657 | 0057 | | | | | |
| 7BC6 | 95 | 0005 | | | | | |
| 7BC7 | 343A | 7C3A | | BNZ | EC10C6 | | |
| | | | | 3. . . THEN | | | |
| | | | | 4. . . . RESET CR1 | | | 5023 |
| 7BC9 | E4 | 0004 | | LR | CRREG | | |
| 7BCA | B7 | 0007 | | TR | CR1 | | |
| 7BCB | 84 | 0004 | | STR | CRREG | | |
| | | | | 4. . . . IF ALIGNER SW=1 | | | 5027 |
| | | | | RIN | CSB02 | | |
| 7BCC | A6C1 | 00C1 | | | | | |
| 7BCE | 90 | 0000 | | TP | CPYATAL | | |
| 7BCF | 46 | 7BD6 | | JZ | EC10C0 | | |
| | | | | 4. . . . THEN | | | |
| | | | | 5. . . . . SET ALIGNTOK | | | 5032 |
| | | | | TSB | PSB23,ALIGNTOK | | |
| 7BD0 | A657 | 0057 | | | | | |
| 7BD2 | AF80 | 0007 | | | | | |
| 7BD4 | A157 | 0057 | | | | | |
| | | | | 4. . . . ENDIF | | | |

TABLE III-continued

```
LOC    OBJ     OP1    OP2          SOURCE STATEMENT                                REF
                7BD6        EC10C0    DC        *
                                  4. . . IF ALIGNTOK=1                              5036
                                      TPB       PSB23,ALIGNTOK
7BD6   A657    0057
7BD8   97      0007
7BD9   3DF0    7BF0                   BZ        EC10C1
                                  4. . . THEN
                                  5. . . . CALL LOGBIN - LOG PAPER LATE(102)        5040
                                  LID       X'0102'
7BDB   AE01    0102
7BDD   29
7BDE   AE02    0102
7BE0   32C04D  0002   4DC0           BAL       R2,LOGBIN
                                  5. . . . RESET RETRY                              5043
                                      TRB       PSB07,RETRY
7BE3   A647    0047
7BE5   B2      0002
7BE6   A147    0047
                                  5. . . . SET ALIGNCPP
                                      TSB       CPP,ALIGNCPP
7BE8   A65D    005D
7BEA   AF10    0004
7BEC   A15D    005D
7BEE   2438    7C38                   B         EC10C5
                                  4. . . ELSE
                7BF0        EC10C1    CD        *
                                  5. . . . IF RETRY=1                               5050
7BF0   A647    0047                   LB        PSB07
7BF2   B2      0002                   TR        RETRY
7BF3   3529    7C29                   BZ        EC10C4
                                  5. . . . THEN                                     5055
                                  6. . . . . RESET RETRY                            5055
7BF5   A147    0047                   STB       PSB07
                                  6. . . . . RESET END
                                      TRB       PSB03,END
7BF7   A643    0043
7BF9   B7      0007
7BFA   A143    0043
                                  6. . . . . DFEXIT=0 CLOSED EXIT GATE
7BFC   A679    0079                   LB        PCB09
7BFE   B4      0004                   TR        DFEXIT
                                      STOUT     09
7BFF   A179    0079                   STB       PCB09
7C01   A1D0    00D0                   STB       CCB09
                                  6. . . . . SET ALIGNCPP
                                      TSB       CPP,ALIGNCPP
7C03   A65D    005D
7C05   AF10    0004
7C07   A15D    005D
                                  6. . . . . IF ANY CR4-CR8                         5059
7C09   E4      0004                   LR        CRREG
7C0A   AB1F    001F                   NI        P1(CR4,CR5,CR6,CR7,CR8)
7C0C   3D21    7C21                   BZ        EC10C2
                                  6. . . . . THEN
                                  7. . . . . . RESET CR2, XFERCOR, CHRGCOR          5064
7C0E   E4      0004                   LR        CRREG
7C0F   B6      0006                   TR        CR2
7C10   84      0004                   STR       CRREG
7C11   A67F    007F                   LB        PCB15
7C13   B6      0006                   TR        XFERCOR
                                      STOUT     15
7C14   A17F    007F                   STB       PCB15
7C16   A1D6    00D6                   STB       CCB15
7C18   A67C    007C                   LB        PCB12
7C1A   B3      0003                   TR        CHRGCOR
                                      STOUT     12
7C1B   A17C    007C                   STB       PCB12
7C1D   A1D3    00D3                   STB       CCB12
7C1F   2C27    7C27                   B         EC10C3
                                  6. . . . . ELSE
                7C21        EC10C2    DC        *
                                  7. . . . . . ALIGNTOK=1                           5077
                                      TSB       PSB23,ALIGNTOK
7C21   A657    0057
7C23   AF80    0007
7C25   A157    0057
                                  6. . . . . ENDIF
                7C27        EC10C3    DC        *
7C27   2C38    7C38                   B         EC10C5
                7C29        EC10C4    DC        *
                                  5. . . . . ELSE
                                  6. . . . . IF NOT STOP2
                                      TPB       PSB23, STOP2                        5088
                                      TPB       PSB23,STOP2
7C29   A657    0057
7C2B   91      0001
7C2C   3C38    7C38                   BNZ       EC10C5
                                  6. . . . . THEN
                                  7. . . . . . SET RETRY & CR1                      5092
                                      TSB       PSB07,RETRY
7C2E   A647    0047
7C30   AF04    0002
7C32   A147    0047
```

TABLE III-continued

| LOC | OBJ | OP1 | OP2 | | SOURCE STATEMENT | | REF |
|---|---|---|---|---|---|---|---|
| 7C34 | E4 | 0004 | | LR | CRREG | | |
| 7C35 | AF80 | 0007 | | | TS | CR1 | |
| 7C37 | 84 | 0004 | | | STR | CRREG | |
| | | | | | 6. . . . . ENDIF | | |
| | | | | | 5. . . . . ENDIF | | |
| | | | | | 4. . . . ENDIF | | 5103 |
| | | 7C38 | | EC10C5 | DC | * | |
| 7C38 | 2C3C | 7C3C | | | B | EC10B | |
| | | 7C3A | | EC10C6 | DC | * | |
| | | | | | 3. . . ELSE | | |
| | | | | | 4. . . . INCREMENT COPY COUNTER- CPYCTR=CCTRSAVE | | 5104 |

The align check latch AC is checked at 5019. If successful, the remaining portion of the EC10 code shown in Table III above is bypassed to code (not shown) executed with respect to CR3 et seq. In FIG. 3 such bypassing is represented by line 90 wherein the code pertinent to the present invention is the EC15 code as later described.

If AC latch in register 67 is a zero, then the control 53 uses instruction 5023 to reset CR1 of the CR register in memory. This action shows that paper was not picked during the previous paper pick try. Then control 53 at step 5027 again checks switch 60. If switch 60 is closed, then align latch 66 is set to the active condition in preparation for setting AT latch of register 67, i.e., picked paper has reached aligner switch 60. Then at 5036 latch 66 is checked. If paper was successfully received at aligner gate 28, as indicated by switch 60, step 5040 is executed which logs paper late indication in the later described CMOS memory, resets the retry latch RE of memory register 67, and sets the align copy paper path check latch PF of register 67. Upon the successful paper path receipt the nonpertinent code is entered for EC10. As shown in FIG. 3 nonpertinent code leads to the EC15 code.

If latch 66 is reset then the program control goes to branch instruction 5050 for checking the condition of the retry indicating latch RE of memory register 67. If the retry latch is a zero, then at 5088 the control 53 checks whether or not the stop button has been pushed. If it has been pushed the EC15 code is entered as shown in FIG. 3; in the constructed embodiment the CR3 code (not shown) of the EC10 code would be entered prior to entering the EC15 code. If the stop button is not activated, then at 5092 control 53 sets the retry latch, i.e., a retry has been executed, and CR1 is set to the active condition. Setting CR1 enables paper pick function to be executed during the next machine cycle. Note that at 5023, CR1 was reset. Hence, if the stop button was pushed no paper pick occurs.

If the entry latch had been set to the one state then the machine should be turned off as only one retry is permitted in the illustrated embodiment. In this regard, retry latch RE acts as a modulo two counter for counting the retries.

Upon the second retry, the control 53 at 5055 resets retry latch RE and sets the align CPP latch PF indicating a paper pick failure. Such paper pick failure will be illuminated on panel 52 informing the operator of the cause of machine stoppage. At branch instruction 5059, control 53 checks to see whether any CR4–CR8 is set to the one state. If any of them are a one state, a sheet of paper is in the paper path portion of copy production machine 10 somewhere between fuser station 31 and the ultimate output. If CR4–CR8 are all zeros, then at 5077 a flag is set for use later in the programming. On the other hand, if a binary one is in any latch of CR4 thru CR8 then at 5064 control 53 resets CR2 latch of the CR memory register and deactivates the corona control. The corona is a high voltage used in charging station 21 to charge the surface of photoconductor drum 20. Then control 53 exits EC10 code portion shown in Table III to a CR3 code portion not pertinent to the present invention and not shown. As shown in FIG. 3 the next pertinent code is the EC15 code beginning with instruction 5544.

The pertinent portion of the EC15 code relating to inhibit copy production in a pick failure is shown in Table IV below.

TABLE IV

| LOC | OBJ | OP1 | OP2 | | SOURCE STATEMENT | | REF |
|---|---|---|---|---|---|---|---|
| | | | | | BEGIN EC15 CODE | | 5522 |
| | | 7E7B | | EC15 | DC | * | 5524 |
| | | | | | 1. FUSER PUFFER OFF | | |
| 7E7B | A673 | 0073 | | | LB | PCB02 | |
| 7E7D | B7 | 0007 | | | TR | FPUFFER | |
| | | | | | STOUT | 02 | |
| 7E7E | A173 | 0073 | | | STB | PCB02 | |
| 7E80 | A1C1 | 00C1 | | | STB | CCB02 | |
| | | | | | 1. IF CR1 | | |
| 7E82 | E4 | 0004 | | | LR | CRREG | |
| 7E83 | 97 | 0007 | | | TP | CR1 | |
| 7E84 | 3D8C | 7E8C | | | BZ | EC15A | |
| | | | | | 1. THEN | | |
| | | | | | 2. . START FUSER TURN-ON INHIBIT(DOC.GLASS SCAN ON) | | 5533 |
| 7E86 | A654 | 0054 | | | LB | PSB20 | |
| 7E88 | AF40 | 0006 | | | TS | SCANTM | |
| 7E8A | A154 | 0054 | | | STB | PSB20 | |
| | | | | | 1. ENDIF | | |
| | | 7E8C | | EC15A | DC | * | |
| | | | | | 1. IF CR2 & NOT CENOPAPR | | |
| 7E8C | E4 | 0004 | | | LR | CRREG | |
| 7E8D | 96 | 0006 | | | TP | CR2 | |
| 7E8E | 3DB3 | 7EB3 | | | BZ | EC15B | |
| 7E90 | A662 | 0062 | | | LB | CEMODE | |
| 7E92 | AB03 | 0003 | | | CI | CENOPAPR | |
| 7E94 | 3DB3 | 7EB3 | | | BE | EC15B | |
| | | | | | 1. THEN | | |
| | | | | | 2. . IF ALIGNER OK AT EC7\|EC8 (ALIGNOK=1) & NOT PRECOND | | 5544 |

TABLE IV-continued

| LOC | OBJ | OP1 | OP2 | SOURCE STATEMENT | | REF |
|---|---|---|---|---|---|---|
| 7E96 | A657 | 0057 | | LB | PSB23 | |
| 7E98 | 95 | 0005 | | TP | ALIGNOK | |
| 7E99 | 3DB3 | 7EB3 | | BZ | EC15B | |
| | | | | TPB | PSB07, PRECOND | |
| 7E9B | A647 | 0047 | | | | |
| 7E9D | 90 | 0000 | | | | |
| 7E9E | 3CB3 | 7EB3 | | BNZ | EC15B | |
| | | | | 2. . THEN | | |
| | | | | 3. . . TURN BERNOULLI ON | | 5549 |
| 7EA0 | A67A | 007A | | LB | PCB10 | |
| 7EA2 | AF40 | 0006 | | TS | BERNULI | |
| | | | | STOUT | 10 | |
| 7EA4 | A17A | 007A | | STB | PCB10 | |
| 7EA6 | A1D1 | 00D1 | | STB | CCB10 | |
| | | | | 3. . . IF LEDSAVE2 | | |
| 7EA8 | E6 | 0006 | | LR | SIZEREG | |
| 7EA9 | 95 | 0005 | | TP | LEDSAVE2 | |
| 7EAA | 43 | 7EB3 | | JZ | EC15B | |
| | | | | 3. . . THEN | | |
| | | | | 4. . . . BERN5 ON | | |
| 7EAB | A67A | 007A | | LB | PCB10 | |
| 7EAD | AF20 | 0005 | | TS | BERNULI5 | |
| | | | | STOUT | 10 | |
| 7EAF | A17A | 007A | | STB | PCB10 | |
| 7EB1 | A1D1 | 00D1 | | STB | CCB10 | |
| | | | | 3. . . ENDIF | | |
| | | | | 2. . ENDIF | | |
| | | | | 1. ENDIF | | 5564 |

At 5544 control 53 checks the align check latch AC of memory register 67 for a one or zero state. If it is in the zero state, all copy production steps are inhibited by bypassing the code beginning at 5549, such as entering instruction at 5563. From 5563 nonpertinent code is executed until the next EC8 time causes execution of branch instruction 4809.

The copy production steps beginning at 5549 include turning the jet 33 on by activating a valve (not shown) for releasing air pressure from air reservoir 33R in copy production machine 10. The instruction at 5558 relates to different size paper to be detached from photoconductor drum 20 and is not pertinent to an understanding of the present invention. All the rest of the EC15 code is not pertinent and is not shown for that reason.

While the invention has been particularly shown and described with reference to preferred embodiments thereof, it will be understood by those skilled in the art that various changes in form and details may be made therein without departing from the spirit and scope of the invention.

What is claimed is:

1. A copy production machine having a cut sheet copy supply, means to pick a sheet from said supply, an image transfer station for receiving a picked sheet for transferring an image thereto, means for removing an imaged sheet from said transfer station, the improvement including in combination:

sense means for sensing a picked sheet ready to enter said image transfer station, timing means indicating timed operation of said transfer station as ready to receive a copy sheet within a first time period and not ready in a second time period, computer means programmed to have:

coincidence means jointly responsive to said sense means and said timing means to indicate sheet pick failure, control means responsive to said failure indication to inhibit transfer of an image for one cycle of said image transfer station, counter means indicating a number of successive pick failures, and control means responsive to said counter means to turn off the copy production machine after a predetermined number greater than one of said pick failures.

2. The copy production machine set forth in claim 1 further including a plurality of sheet supplies, and said timing means altering said time periods for different ones of said sheet supplies.

3. A copy production machine having a photoconductor member relatively movable past a plurality of operating stations including a developer including means receiving toner, transfer station, a detach station and a cleaning station, an aligner gate at an input to the transfer station, timed means to sense copy paper at said aligner gate when a latent image is approaching the developer station to be developed, the improvement being in combination:

means detecting no paper adjacent said aligner gate, means reinitiating picking a sheet of copy paper to receive an image normally transferred by said latent image, means responsive to said reinitiating means to inhibit said detach station and said receiving means for one machine cycle.

4. The machine set forth in claim 3 including means stopping said machine after a predetermined number of unsuccessful retries of picking paper and inhibiting said detach station.

5. A method of operating a copy production machine having a transfer electrographic mechanism with a charging station, developing station, transfer station, and a detach station, means for transporting copy paper to said transfer station and means indicating the success or lack of success of such transport, the method including the steps of dividing machine operations into successive cycles, each cycle corresponding to transferring one image to a sheet of copy paper, continuously sensing for copy paper at an input portion of said transfer station, and in a computer, verifying operations of said copy transport and allowing copy production only upon detecting successful copy sheet transport to said input portion, in the event of detecting an unsuccessful transport in a first portion of said cycle turning off transfer corona in said transfer station, altering the development bias on said developing station, inhibiting toner supply from moving into said developing station, logging the failure in a nonvolatile memory, in the later part of the cycle inhibiting document feeding, and in the later part of said cycle initiating a paper pick retry, inhibiting detach operations of said copier, and in the next cycle attempting a retry and if successful continuing with copy production, and if unsuccessful turning the machine off.

* * * * *